United States Patent [19]

Bland et al.

[11] Patent Number: 4,579,535

[45] Date of Patent: Apr. 1, 1986

[54] STEERING MECHANISM

[75] Inventors: Gerald F. Bland, Glenview; Donald K. Sullivan, Waukegan, both of Ill.

[73] Assignee: Outboard Marine Corporation, Waukegan, Ill.

[21] Appl. No.: 750,056

[22] Filed: Jun. 27, 1985

Related U.S. Application Data

[63] Continuation of Ser. No. 524,749, Aug. 19, 1983, abandoned.

[51] Int. Cl.[4] ..... B63H 21/26

[52] U.S. Cl. ..... 440/62

[58] Field of Search ..... 440/53, 55, 56, 58–65; 114/144 R; 74/501.5

[56] References Cited

U.S. PATENT DOCUMENTS

| | | | |
|---|---|---|---|
| Re. 23,933 | 2/1955 | Cushman | 74/501.5 |
| 1,961,506 | 6/1934 | Millican | 440/62 |
| 2,837,051 | 6/1958 | Friedrich | 440/62 |
| 2,841,030 | 7/1958 | Wrighton | 74/501.5 |
| 2,934,971 | 5/1960 | Phelan | 74/501.5 |
| 2,992,568 | 7/1961 | Benkovsky et al. | 74/501.5 |
| 3,072,090 | 3/1961 | Yarbrough | 440/62 |
| 3,180,176 | 4/1965 | Maagd et al. | 74/501.5 |
| 3,277,738 | 10/1966 | Glauser et al. | 74/501.5 |
| 3,376,842 | 5/1960 | Wynne | 440/62 |
| 3,433,089 | 3/1969 | Geyer | 74/501.5 |
| 3,606,853 | 9/1971 | Hsu | 114/20 |
| 3,814,047 | 6/1974 | Carpenter | 440/55 |
| 4,040,375 | 8/1977 | Atkins et al. | 114/144 R |
| 4,318,308 | 3/1982 | Monteillet | 74/501.5 |

FOREIGN PATENT DOCUMENTS

| | | | |
|---|---|---|---|
| 215923 | 10/1967 | Sweden | 74/501.5 |
| 20127 | of 1903 | United Kingdom | 440/58 |

*Primary Examiner*—Galen L. Barefoot
*Assistant Examiner*—Jesûs D. Sotelo
*Attorney, Agent, or Firm*—Michael, Best & Friedrich

[57] ABSTRACT

A marine propulsion device comprising a transom unit adapted to be mounted on a marine vehicle, a swivel support pivotally mounted on the transom unit for vertical tilting movement about a horizontal tilt axis, a lower unit pivotally steerable relative to the swivel support about a vertical steering axis, and a steering mechanism for pivoting the lower unit about the steering axis. The steering mechanism comprises a first pulley rotatably mounted on the transom unit, a steering arm for rotating the first pulley, and cables for connecting the first pulley to the lower unit so that the lower unit pivots in response to rotation of the first pulley. The steering mechanism also includes a second pulley and the lower unit is pivotally steerable relative to the swivel support by rotatably mounting the second pulley on the swivel support and by fixedly attaching the lower unit to the second pulley. The cables are connected to the lower unit by connecting the cables to the second pulley. The steering mechanism also includes guides between the first pulley and the second pulley through which the cables extend for maintaining the relative distance along the cables between the first pulley and the second pulley when the swivel support pivots about the tilt axis.

14 Claims, 5 Drawing Figures

STEERING MECHANISM

This application is a continuation of Ser. No. 524,749 filed Aug. 19, 1983, now abandoned.

BACKGROUND AND SUMMARY OF THE INVENTION

This invention relates to marine propulsion devices including means for pivoting a propulsion unit about a steering axis to effect steering of a marine vehicle. Attention is directed to Wynne U.S. Pat. No. 3,376,842 and Yarbrough U.S. Pat. No. 3,072,090 which disclose marine propulsion devices including steering mechanisms.

This invention provides a marine propulsion device comprising a transom unit adapted to be mounted a marine vehicle, a swivel support pivotally mounted on the transom unit for vertical tilting movement about a horizontal tilt axis, a lower unit pivotally steerable relative to the swival support about a vertical steering axis, and steering means for pivoting the lower unit about the steering axis. The steering means comprises a member rotatably mounted on the transom unit, means for rotating the member, and belt means for connecting the member to the lower unit so that the lower unit pivots in response to rotation of the member.

In one embodiment, the member is a first pulley and the steering means further includes a second pulley. The propulsion unit is pivotally steerable relative to he swivel support by rotatably mounting the second pulley on the swivel support and be fixedly attaching the propulsion unit to the second pulley. The belt means is connected to the propulsion unit by connecting the belt means to the second pulley. The steering means also includes guide means between the first pulley and the second pulley through which the belt means extends for maintaining the relative distance along the belt means between the first pulley and the second pulley when the swivel support pivots about the tilt axis.

In one embodiment, the means for rotatably mounting the first pulley on the transom unit includes a journal fixedly attached to the transom unit and the first pulley comprises a pulley segment rotatably mounted on the journal. The first pulley forms part of an assembly which includes retaining means for connecting the belt means to the pulley. The retaining means is rotatably mounted on the journal adjacent the pulley segment and pivotable relative to the pulley segment to permit adjustment of the tension of the belt means. The assembly also includes adjustment means between the pulley segment and the retaining means to rotate and hold the retaining means relative to the pulley segment to adjust the tension of the belt means.

One of the principal features of the invention is to provide a means for steering a propulsion unit which is operable by a conventional steering cable arrangement.

Another of the principal features of the invention is to provide such a steering means which is operable either in its running position or in its tilted up or out-of-the-water position.

Other features and advantages of embodiments of the invention will become apparent upon reviewing the following drawings, the detailed description and the appended claims.

Figure 1:
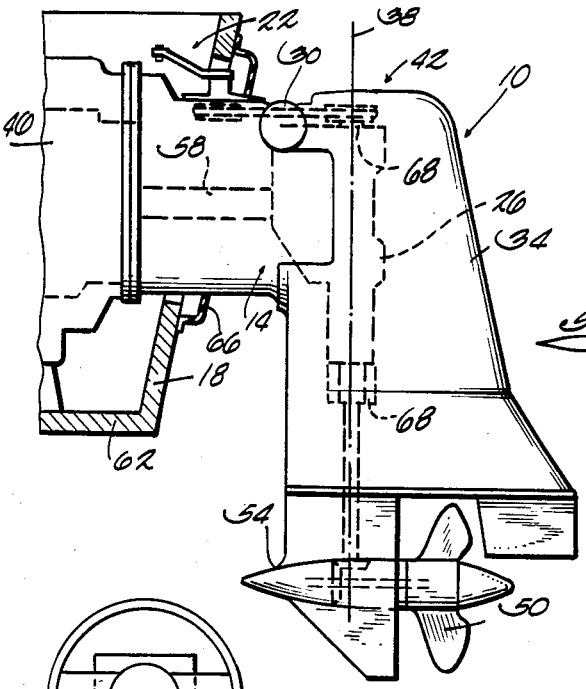
FIG. 1 is a side view, partially in section of a stern drive which embodies various of the features of the invention.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

As illustrated in the drawings, this invention provides a marine propulsion device 10 including a transom unit 14 adapted to be mounted through the transom 18 of a boat 22, a swivel support 26 pivotally mounted on the transom unit 14 for vertical tilting movement about a horizontal tilt axis 30, a lower unit 34 pivotally steerable relative to the swivel support 26 about a vertical steering axis 38 and steering means 42 for pivoting the lower unit 34 about the steering axis 38.

As more particularly illustrated in FIG. 1, the transom unit 14, swivel support 26 and lower unit 34, together with an engine 46 comprise portions of a stern drive for the boat 22. In other embodiments, the various units may form portions of an outboard motor or other marine propulsion device.

The engine 46 drives a propeller 50 rotatably mounted on a gear case 54 forming part of the lower unit 34. The engine 46 drives the propeller 50 by means of a drive train 58 which extends through the transom unit 14, swivel support 26 and lower unit 34.

The transom unit 14 is provided aft of the engine 46 and the stern drive 10 is securely mounted to the frame 62 of the boat 22. The transom unit 14 extends through the transom wall 18 of the boat 22 and is surrounded by a waterproof membrane 66 for purposes of preventing water infiltration into the boat 22 around the transom unit 14.

The swivel support 26 is pivotally mounted on the transom unit 14 for vertical tilting movement of the swivel support 26 and lower unit 34 about the horizontal axis 30. The vertical tilting movement is provided to allow the lower 34 and propeller 50 to be raised out of the water.

The lower unit 34 is pivotally mounted on the swivel support 26 by means of bearings 68. The bearings 68 permit the lower unit 34 to turn on the ends of the swivel support 26 and the ends of swivel support 26 defines the vertical steering axis 38. A more detailed description of the mounting of the engine 46, transom unit 14, swivel support 26 and lower unit 34 is contained in Schimanckas U.S. Pat. No. 3,183,880 issued May 18, 1965, which is incorporated herein by reference.

The steering means 42 for pivoting the lower unit 34 about the steering axis 38 comprises a first member or pulley 70 rotatably mounted on the transom unit 14, means 74 for rotating the first pulley 70, a second pulley 78 fixedly attached to the lower unit 34, and belt means 82 for connecting the first pulley 70 to the second pulley 78 so that the second pulley 78 pivots the lower unit 34 in response to rotation of the first pulley 70.

Figure 2:
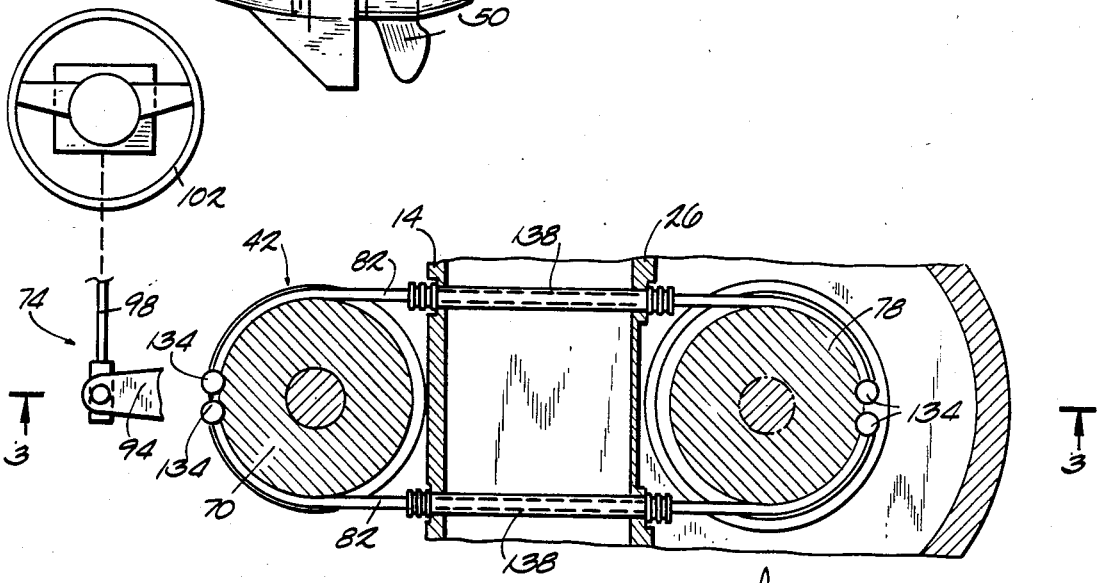
FIG. 2 is a partially broken away top view of the means for steering the stern drive shown in FIG. 1.
Figure 3:
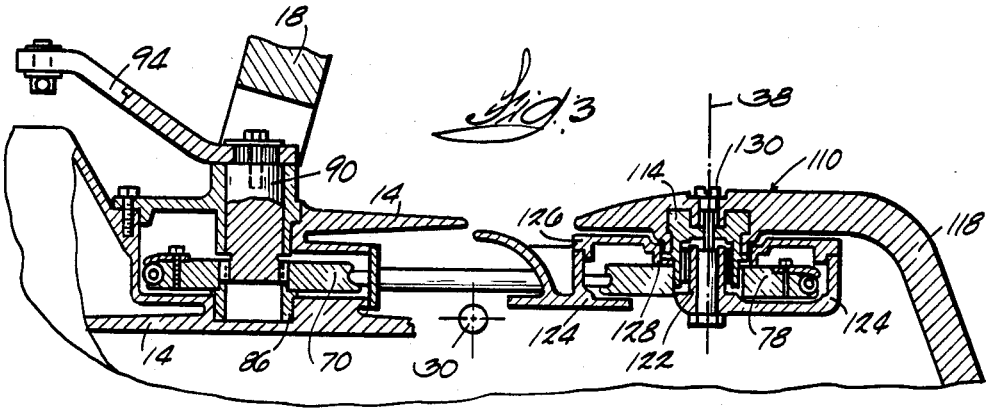
FIG. 3 is a cross-sectional side view taken along the line 3—3 in FIG. 2.

More particularly, as illustrated in FIGS. 2 and 3, the first pulley 70 is rotatably mounted on the transom unit 14 by means of a journal 86 fixedly attached to the transom unit 14. The first pulley 70 includes an upwardly extending spline 90 and the means 74 for rotating the first pulley 70 includes a radially extending steering arm 94 attached to the spline 90. The steering arm 94 can be connected to a conventional steering cable 98 and the first pulley 70 is rotatable in response to operator actuating means in the form of a steering wheel 102 connected to the steering cable 98.

As more particularly illustrated in FIG. 3, the lower unit 34 is rotatably mounted on the swivel support 26 by means of the assembly 110 which also forms the upper bearing 68. The assembly 110 includes an insert 114 which fixedly attaches the upper portion 118 of the lower unit 34 to the second pulley 78. The assembly 110 also includes a journal 122 on the top 124 of the swivel support 26 upon which the second pulley 78 is rotatably mounted. A cover 126 extends between the lower unit 34 and the second pulley 78 and the insert 114 extends through an opening 128 in the cover 126. The lower unit 34, second pulley 78 and cover 126 are held in place by the weight of the lower unit 34 and a bolt 130 extends through the lower unit 34, insert 114 and the journal 122 and serves as an oil fill plug. When the second pulley 78 rotates on the journal 122, the lower unit 34 rotates with the second pulley 78 and pivots on the bearing 68 about the vertical steering axis 38.

Referring again to FIG. 2, belt means in the form of cables 82 connect the first pulley 70 to the second pulley 78 so that the second pulley 78 pivots the lower unit 34 when the first pulley 70 rotates in response to movement of the steering arm 94. Each of the two cables 82 is connected to a side of each of the first and second pulleys 70 and 78, respectively, by fastening means 134. When the first pulley 70 rotates, one of the two cables 82 serves to pull the periphery of the second pulley 78 so that the second pulley 78 rotates in the same direction as the first pulley 70.

Fixedly attached to and extending between the transom unit 14 and the swivel support 26 is guide means or guides 138 through which the cables 82 extend. The guides 138 maintain the relative distance along the cables 82 between the first pulley 70 and second pulley 78 when the swivel support 26 and lower unit 34 pivot about the tilt axis. More particularly, the guides 138 comprise a pair of flexible tubes each of which is connected at one end to the transom unit 14 and at the other end to the swivel support 26. By having the cables 82 extend through the guides 138, the cables 82 are prevented from slackening by maintaining the relative cable travel distance between the first pulley 70 and the second pulley 78, even though the first pulley 70 and the second pulley 78 come closer together as the swivel support 26 and lower unit 34 pivot about the tilt axis 30. In another embodiment, the guides 138 can comprise pulleys (not shown) above the cables 82 with their periphery holding the cables 82 at the tilt axis 30.

Figure 4:
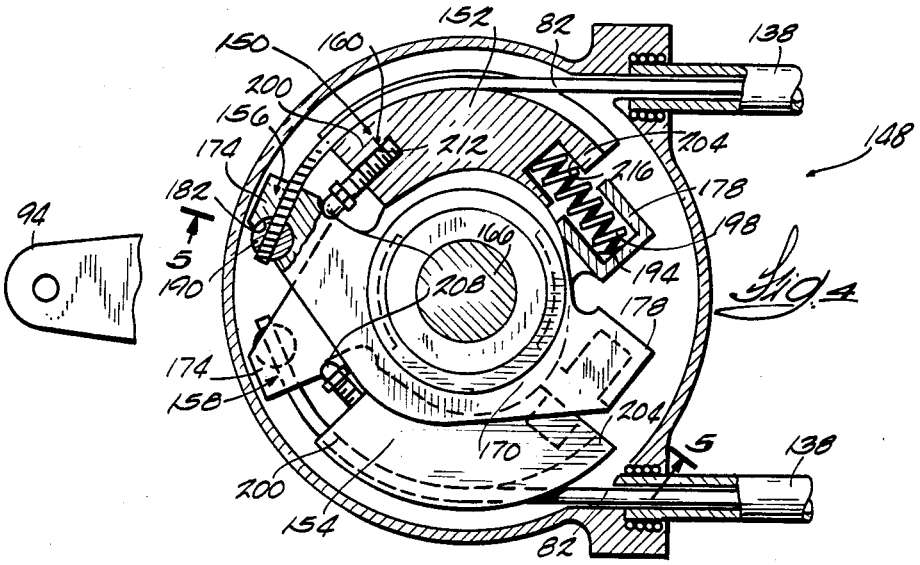
FIG. 4 is an enlarged top view, partially broken away, of an alternate embodiment of the pulley shown on the left in FIGS. 2 and 3.
Figure 5:
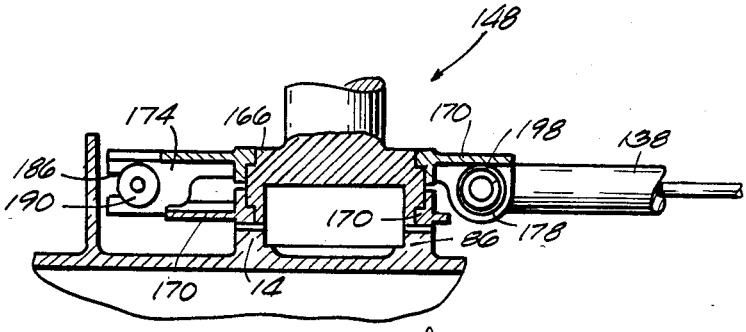
FIG. 5 is a cross-sectional side view taken along the line 5—5 in FIG. 4.

The marine propulsion device 10 can also include an assembly 148 providing means for adjusting the tension of the cables 82. As shown in FIGS. 4 and 5, one such assembly 148 includes an alternate embodiment 150 of the first pulley 70. In this embodiment, the first pulley 150 comprises pulley segments 152 and 154 rotatably mounted on the journal 86. The assembly 148 also includes retaining means or members 156 and 158 for connecting the cables 82 to the pulley 150 and pivotable relative to the pulley segments 152 and 154, and adjustment means 160 between respective pulley segments 152 and 154 and retaining members 156 and 158 to rotate and hold the retaining members 156 and 158 relative to the pulley segments 152 and 154 in order to adjust the tension of the cables 82.

The pulley segments 152 and 154 comprise outwardly extending opposed flanges extending from a spline 166 to which the radially extending steering arm 94 is connected. In this embodiment, the pulley segments 152 and 154 and spline 166 are a single unitary piece 150. The spline 166 is rotatably mounted on the journal 86 on the top of the transom unit 14.

Each of the retaining members 156 and 158 comprises a horizontal flat plate 170 with a first end 174 and second end 178 which extend perpendicular from the plate 170. The first end 174 includes a socket 182 and slot 186 for receiving a ball 190 attached to the end of one of the cables 82 and the second end 178 includes a socket 194 for receiving a spring 198, as hereinafter described.

One retaining member 156 is piloted on the spline 166 of the pulley 150 below the pulley segments 152 and 154 and is disposed so that the first and second ends 174 and 178 of the retaining member 156 are in the same plane as the pulley segments 152 and 154. The other retaining member 158 is flipped and piloted on the spline 166 of the pulley 150 above the pulley segments 152 and 154 and is disposed so that the first and second ends 174 and 178 of the retaining member 158 are in the same plane as the pulley segments 152 and 154. As illustrated in FIG. 4, the first ends 174 of the retaining members 156 and 158 are, therefore, in the same plane so that the cables 82 can be connected to the pulley 150 in the same plane. The first ends 174 of the retaining members 156 and 158 are also adjacent one another.

Each of the pulley segments 152 and 154 include a first end 200 and a second end 204, and the first end 200 of each of the pulley segments 152 and 154 is adjacent the first ends 174 of the retaining members 156 and 158, and the second end 204 of each of the pulley segments 152 and 154 is adjacent the second ends 178 of the retaining members 156 and 158.

The adjustment means 160 includes means 208 for varying the spacing between the first ends 174 and 200 of the respective pulley segments 152 and 154 and retaining members 156 and 158. The means are in the form of pins 208 which are respectively threaded in bores 212 in the first ends 200 of each of the pulley segments 152 and 154. The pins 208 extend to the first ends 174 of the respective retaining members 156 and 158. The pins 208 are movable between first positions and second positions wherein the first ends 174 of retaining members 156 and 158 are spaced further from the first ends 200 of the respective pulley segments 152 and 154 than in the first position. Accordingly, by adjusting the pins 208 by threading them into or out of the bores 212, the spacing of the retaining members 156 and 158 relative to the respective pulley segments 152 and 154 can be changed in order to adjust the tension of the cables 82.

The adjustment means 160 also includes biasing means 198 between the second ends 178 of each of the retaining members 156 and 158 and the second ends 204 of the respective pulley segments 154 and 152 for biasing the second ends 178 of the retaining members 156 and 158 towards the second ends 204 of the respective pulley segments 152 and 154. As illustrated in FIG. 4, the biasing means are in the form of springs 198 received in opposed sockets 194 and 216, respectively, in the second ends 178 and 204 of the retaining members 156 and 158 and pulley segments 152 and 154. The springs 216 cause the first ends 200 of each of pulley segments 152 and 154 and the first ends 174 of the respective retaining members 156 and 158 to be biased away from the pins 208. Thus, any slack present in the cables 82 after adjustment of the pins 208 is taken up by the spring 198.

Various of the features of the invention are set forth in the following claims.

We claim:

1. A marine propulsion device comprising a transom unit adapted to be mounted on a marine vehicle, a swivel support pivotally mounted on said transom unit for vertical tilting movement about a horizontal tilt axis, a lower unit pivotally mounted on said swivel support for steering movement relative to said swivel support about a steering axis transverse to said tilt axis, and steering means for pivoting said lower unit about said steering axis regardless of swivel support tilting movement about said tilt axis, said steering means comprising a member rotatably mounted on said transom unit about an axis fixed in relation to said transom unit, and belt means connecting said member to said lower unit for pivoting said lower unit in response to rotation of said member.

2. A marine propulsion device in accordance with claim 1 and further including means for rotating said member.

3. A marine propulsion device in accordance with claim 1 wherein said steering means further includes guide means between said member and said lower unit through which said belt means extends for maintaining the relative distance along said belt means between said member and said lower unit when said swivel support pivots about said tilt axis.

4. A marine propulsion device comprising a transom unit adapted to be mounted on a marine vehicle, a swivel support pivotally mounted on said transom unit for vertical tilting movement about a horizontal tilt axis, a lower unit pivotally mounted on said swivel support for steering movement relative to said swivel support about a steering axis transverse to said tilt axis, and steering means for pivoting said lower unit about said steering axis, said steering means comprising a journal fixedly attached to said transom unit about an axis fixed in relation to said transom unit, a pulley segment rotatably mounted on said journal, belt means connected to said lower unit for pivoting said lower unit in response to movement of said belt means, retaining means for connecting said belt means to said pulley segment, said retaining means being rotatably mounted on said journal adjacent said pulley segment and pivotable relative to said pulley segment to permit adjustment of the tension of said belt means, and adjustment means between said pulley segment and said retaining means to rotate and hold said retaining means relative to said pulley segment to adjust the tension of said belt means.

5. A marine propulsion device in accordance with claim 4 wherein said pulley segment includes a first end and a second end and wherein said retaining means includes a first end and a second end, and wherein said first end of said pulley segment is adjacent said first end of said retaining means and said second end of said pulley segment is adjacent said second end of said retaining means, and wherein said adjustment means includes a pin secured between said first end of said pulley segment and said first end of said retaining means and movable between a first position and a second position in which said first end of said retaining means is spaced further from said first end of said pulley segment than in said first position.

6. A marine propulsion device in accordance with claim 5 wherein said adjustment means further includes biasing means for biasing said second end of said retaining means toward said second end of said pulley segment so as to bias said first end of said pulley segment away from said first end of retaining means to take up slack in said belt means.

7. A marine propulsion device comprising a transom unit adapted to be mounted on a marine vehicle, a swivel support pivotally mounted on said transom unit for vertical tilting movement about a horizontal tilt axis, a lower unit pivotally mounted on said swivel support for steering movement relative to said swivel support about a steering axis transverse to said tilt axis, and steering means for pivoting said lower unit about said steering axis regardless of swivel support tilting movement about said tilt axis, said steering means comprising a first pulley rotatably mounted on said transom unit about an axis fixed in relation to said transom unit, a second pulley fixedly attached to said lower unit, and belt means connecting said first pulley to said second pulley for pivoting said second pulley and said lower unit in response to rotation of said first pulley.

8. A marine propulsion device in accordance with claim 7 and further including means for rotating said first pulley.

9. A marine propulsion device in accordance with claim 7 wherein said steering means further includes guide means between said first pulley and said second pulley through which said belt means extends for maintaining the relative distance along said belt means between said first pulley and said second pulley when said swivel support pivots about said tilt axis.

10. A marine propulsion device in accordance with claim 7 wherein said belt means comprises two cables attached to said first pulley and said second pulley.

11. A marine propulsion device comprising a transom unit adapted to be mounted on a marine vehicle, a swivel support pivotally mounted on said transom unit for vertical tilting movement about a horizontal tilt axis, a lower unit pivotally mounted on said swivel support for steering movement relative to said swivel support about a steering axis transverse to said tilt axis, and steering means for pivoting said lower unit about said steering axis, said steering means comprising a journal fixedly attached to said transom unit about an axis fixed in relation to said transom unit, a first pulley rotatably mounted on said journal, and comprising a pulley segment rotatably mounted on said journal, a second pulley fixedly attached to said lower unit, belt means connected to said second pulley for pivoting said second pulley and said lower unit in response to belt movement, retaining means rotatably mounted on said journal adjacent said pulley segment and pivotable relative to said pulley segment to permit adjustment of the tension of said belt means, and adjustment means between said pulley segment and said retaining means to rotate and hold said retaining means relative to said pulley segment to adjust the tension of said belt means.

12. A marine propulsion device in accordance with claim 11 wherein said pulley segment includes a first end and a second end, and wherein said retaining means includes a first end and a second end, and wherein said first end of said pulley segment is adjacent said first end of said retaining means and said second end of said pulley segment is adjacent said second end of said retaining means, and wherein said adjustment means includes a pin secured between said first end of said pulley segment and said first end of said retaining means and movable between a first position and a second position in which said first end of said retaining means is spaced further from said first end of said pulley segment than in said first position.

13. A marine propulsion device in accordance with claim 12 wherein said adjustment means further includes biasing means for biasing said second end of said retaining means toward said second end of said pulley segment so as to bias said first end of said pulley segment away from said first end of retaining means to take up slack in said belt means.

14. A marine propulsion device comprising a transom unit adapted to be mounted on a marine vehicle, a swivel support pivotally mounted on said transom unit for vertical tilting movement about a horizontal tilt axis, a lower unit pivotally mounted on said swivel support for steering movement relative to said swivel support about a steering axis transverse to said tilt axis, and steering means for pivoting said lower unit about said steering axis regardless of swivel support tilting movement about said tilt axis, said steering means comprising a member rotatably mounted on said transom unit about an axis fixed in relation to said transom unit, belt means connected to one of said member and said lower unit, and means for adjustably connecting said belt means to the other of said member and said lower unit, whereby said lower unit is pivotal relative to said swivel support in response to belt movement.

* * * * *